United States Patent [19]

Shinoto

[11] Patent Number: 4,693,525

[45] Date of Patent: Sep. 15, 1987

[54] CASING FOR ELECTRONIC APPARATUS

[75] Inventor: Yoshinori Shinoto, Tokyo, Japan

[73] Assignee: Linguatron Limited, Hamilton, Bermuda

[21] Appl. No.: 831,986

[22] Filed: Feb. 21, 1986

[30] Foreign Application Priority Data

May 28, 1985 [JP] Japan ..... 60-114659

[51] Int. Cl.[4] ..... A47B 81/00

[52] U.S. Cl. ..... 312/208; 220/335; 312/325

[58] Field of Search ..... 312/138 R, 258, 297, 312/324, 208, 325; 220/334, 335, 337; 160/210, 213

[56] References Cited

U.S. PATENT DOCUMENTS

| | | | |
|---|---|---|---|
| 614,867 | 11/1898 | Huffmal | 160/210 |
| 843,191 | 2/1907 | Allen | 220/335 |
| 1,236,040 | 8/1917 | Barrow | 160/210 |
| 2,285,159 | 6/1942 | Hanson et al. | 312/325 X |
| 2,599,362 | 6/1952 | Belsky | 220/337 |
| 4,145,097 | 3/1979 | Naess et al. | 312/208 |
| 4,289,362 | 9/1981 | Kramer | 160/213 |
| 4,460,105 | 7/1984 | Cox | 220/335 |

FOREIGN PATENT DOCUMENTS

| | | | |
|---|---|---|---|
| 090401 | 10/1983 | European Pat. Off. . | |
| 423836 | 4/1966 | Switzerland | 312/208 |
| 130244 | 7/1919 | United Kingdom | 220/335 |
| 368897 | 3/1932 | United Kingdom . | |
| 986244 | 3/1965 | United Kingdom . | |

*Primary Examiner*—Joseph Falk

*Attorney, Agent, or Firm*—Wolf, Greenfield & Sacks

[57] ABSTRACT

A casing for an electronic apparatus having a foldable lid pivotally connected at one edge thereof to the casing body. The lid is movable between an extended closed position in which it covers a portion of the casing, and a folded open position in which it allows access to said portion of the casing.

The casing is characterized by the arrangement of the means for securely retaining the lid in the folded open position in such a manner that the user can use the lid as, for example, a rigid paper support which allows revisions to be made on the typed paper during the operation of the apparatus.

5 Claims, 4 Drawing Figures

CASING FOR ELECTRONIC APPARATUS

FIELD OF THE INVENTION

The present invention relates to a casing used for electronic apparatus such as electronic typewriters and word processors and more particularly to a construction for such a casing incorporating a lid which is pivotally attached thereto.

BACKGROUND OF THE INVENTION

Electronic apparatus such as electronic typewriters, etc. which are designed to be portable are generally provided with a lid for covering the upper surface thereof (i.e. the surface on which the keyboard, etc. are provided) to prevent the entry of foreign matter such as water, dust, etc. as well as to protect the portions therein which are vulnerable to mechanical impact such as the printing mechanism, keyboard, etc.

Among prior art electronic apparatus are casing in which a plastic lid is provided as a part which is removable with respect thereto. In such conventional apparatus, however, the plastic lid when removed can be dropped accidentally onto the floor or may strike the body of the apparatus such as to damage either or both of them while the apparatus is in use. Besides these problems, inconvenience may be experienced due to the need to find storage space for the lid when removed, coupled with the possibility of it becoming lost at such times.

Furthermore, there are also prior art apparatus wherein a lid is formed of two plastic plates which are pivotally connected together along their adjacent edges. The edge of one plate which is remote from its pivotally connected edge is pivotally attached to the casing.

In the above-mentioned prior art apparatus, the lid in its extended state is fixed at a predetermined portion of the upper surface of the casing while the apparatus is not in use and one of the plastic plates (the one referred to above) is inclined rearwards such as to lean against the predetermined portion of the upper surface of the casing so that the other plate will depend therebehind.

This apparatus is not provided with any means for retaining the lid fixedly and securely when opened in such a condition and the lid cannot be used for any useful purpose during the use of the apparatus, because its mechanical strength is small.

An object of the invention is to provide an improved casing for an electronic apparatus having such a pivotable lid wherein the lid is made capable of being used for other useful purposes (e.g. as a paper holder for accommodating the paper on which typing is being conducted and thus as a support allowing one to write on the paper with a pencil or the like or to erase letters with a rubber) during the use of the apparatus by constructing it in such a way that it can be fixedly folded.

SUMMARY OF THE INVENTION

To achieve the above-mentioned object, the casing for electronic apparatus constructed in accordance with the invention is provided with: a lid attached pivotally thereto which is movable between a closed position covering a predetermined portion of said casing and an open position wherein the predetermined portion is exposed, said lid being composed of a first rectangular platelike member, one of the side edges of which is attached proximate and substantially parallel to the rear edge of the upper surface of said casing, and a second rectangular platelike member, one of the side edges of which is attached pivotally to the other side edge of the first member so that the above-mentioned open position may be such that the side edges of the second platelike member will be respectively positioned rearwardly and forwardly of said one of the side edges of the first member; and with a first fixing means for fixing the lid to the fixed position and a means for fixing the other side edge of the second member (i.e. the edge not attached to the first member) to the upper surface of the casing.

The casing according to the invention allows the electronic apparatus to be operated without removing the lid, because the lid is attached both pivotally and foldably. The lid will not become an obstacle to operating the apparatus because during operation it can be folded such as to be retained in a compact manner, and yet, as described above, this lid can also be used as a robust paper holder.

BRIEF EXPLANATION OF THE DRAWINGS

The invention is now described in more detail as follows, to the appended drawings.

DESCRIPTION OF THE PREFERRED EMBODIMENT

Figure 1:
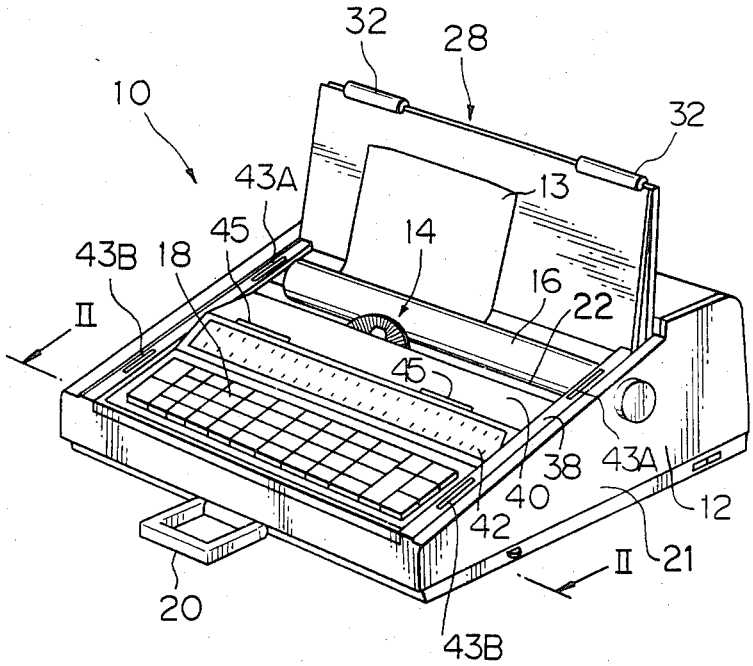
FIG. 1 is a perspective view illustrating the external appearance of the casing according to the invention which is used for electronic typewriters.

In FIG. 1 there is shown an electronic typewriter 10 provided with a casing 12 constructed in accordance with the invention. The casing 12 includes a casing body 21 having an upper surface with an open portion 22. In the interior of this casing 12 are provided a printing mechanism 14, a platen 16, an electric motor (not shown) for driving the same and the like, while a keyboard 18 is provided on its upper surface. At the lower edge of the front surface of the casing 12 is pivotally attached a handle 20 which can, as shown by the broken line in FIG. 3, be housed within its bottom portion 26. On the upper surface of the casing 12 is provided a lid 28 for protecting the interior thereof, the lid being composed of two rectangular platelike members 28A and 28B. One of the side edges of the first member 28A is attached pivotally by means of a pivot member 30 proximate to the rear edge of the upper surface of the casing, while the other side edge is attached pivotally by means of a pivot member 32 to the side edge of the second member 28B.

Figure 3:
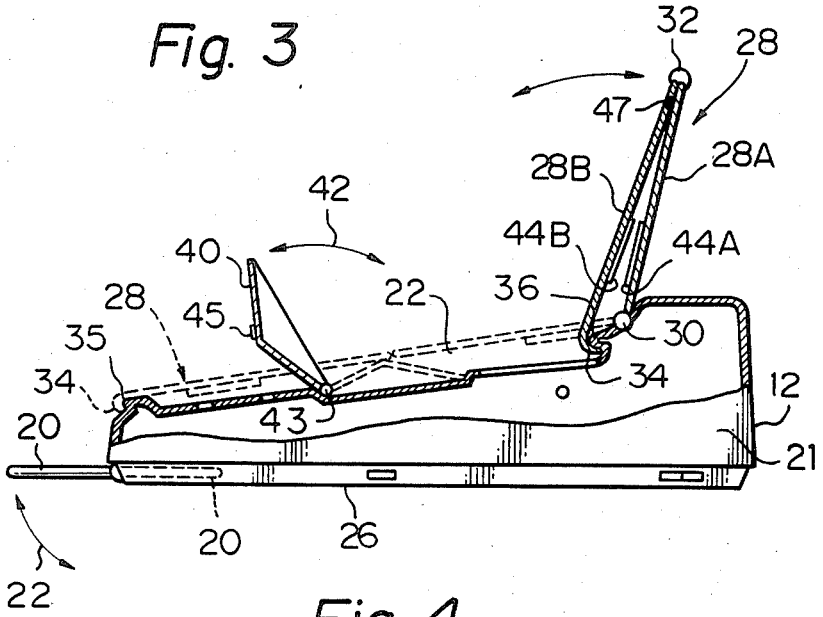
FIG. 3 is a partially cutaway side elevational view illustrating the casing and the lid used for the electronic typewriter in FIG. 1.

Thus by extending both members, this lid can be moved to a closed position covering the upper surface of the casing (as shown by the broken line in FIG. 3) and by folding both members, the lid can be moved to an open position (as shown by the solid line) where they are erected with a slightly rearward inclination with respect to the casing. In this open position, as shown in FIG. 3, the side edge of the second member 28B which is connected to the pivot member 32 is positioned rearwardly of the pivot member 30, while the opposite edge of said member 28B (front edge portion 34) is positioned forwardly of the pivot member 30. On the casing 12 are also provided a first and a second fixing means for respectively fixing the lid 28 in the above-described open and closed positions. In the embodiment illustrated, the first fixing means for fixing the lid 28 in the closed position is composed of the inwardly curved front edge portion 34 of the second member 28B and a convex portion 35 provided on the upper surface of the casing.

The convex portion 35 has a curved portion of such a configuration as to fit substantially intimately with the front edge portion 34 whereby it can be fitted thereto by being pressed from above and thereby retained fixedly by said portion 34.

A variety of arrangements could be conceived for the first fixing means apart from the one described above wherein the convex portion on the upper surface of the casing and the front edge portion of the lid are detachably fitted to each other. For example, laterally retractable latch members may be provided at both side edge portions of the lid, while latch apertures which allow said latch members to be inserted therein when the lid is closed may be provided on the upper surface of the casing so that the lid can be retained fixedly in the closed position by virtue of their engagement.

Figure 4:
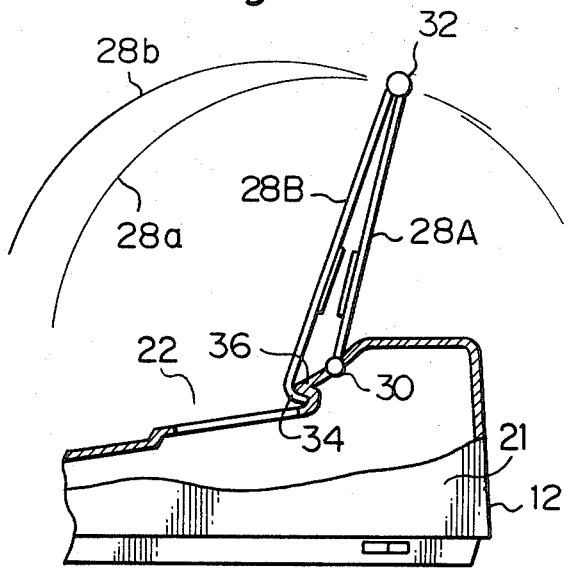
FIG. 4 a partially cutaway side elevational view illustrating the movement of the lid used for the typewriter shown in FIG. 1.

The second fixing means is composed of a protrusion 36 provided on the upper surface of the casing 12 for engaging the front edge portion 34 of the second plate member 28B when the lid is in its folded condition, this portion being retained fixedly by being pressed in the rearward direction against the protrusion 36. When the lid is in the closed position, the front edge portion 34 of the member 28B is engaged with the protrusion 36, and the pivot member 32 is at the intersection of the locus **28*b* of the member 28B as it turns about the protrusion 36 and the locus 28*a* of the other member 28A as it turns about the pivot member 30, as shown in FIG. 4**.

Since these members 28A, 28B, 30 and 32 occupy the positional relation described above and illustrated in FIG. 4, the lid 28 is able to maintain its open position even against any substantial force which might act to push or pull the same back and forth. Consequently, as shown in FIG. 1, the open lid 28 can be used as a rigid paper holder (that is, a reliable means for supporting the printed paper 13) by means of which the user is able to make revisions of the printed matter. The second platelike member 28B is firmly fixed to the casing 12 in the open position, so that is allows the paper 13 to slide downwardly toward a predetermined position behind the platen 16 so as to be rolled therein when the paper 13 is put on the second plate-like member 28B.

Figure 2:
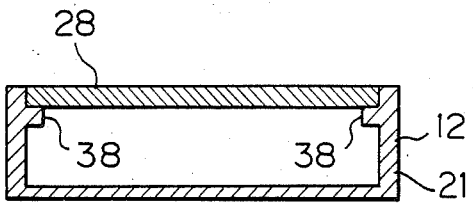
FIG. 2 is a cutaway view of the casing taken along the line II—II of FIG. 1.

On the surfaces of the right and left inner walls of casing 12 are formed steps 38 which extend in the rearward and forward directions (FIG. 2). Each of the steps 38 supports a side edge of the lid 28 when it is in the closed position, serving as a rest which prevents the lid 28 from being folded into the interior of the casing 12. The casing 12 also has a member 40 of V-shaped cross section for supporting the lid 28. This V-shaped member 40 can be pivoted, as shown in FIG. 3 by the arrow 42, about the axis 43 which is parallel to the pivot member 30 of plate members 28A and 28B. The V-shaped member 40 acts to support the central portion of the lower surface of the lid 28 which abuts it when it is housed within the interior of casing 12 (that is, when it is in the position indicated by the dotted lines in FIG. 3). This V-shaped member is graduated as shown at 42 as an indication of the printing pitch.

Additionally, magnetic force is used in the embodiment illustrated to securely retain the lid 28 in its closed position, that is, magnetic strips 43A, 43B and 45 are bound on or buried in the steps 38 of the upper surface of the casing and the V-shaped member 40 while magnetic strips 44A, 44B and 47 which are so magnetized as to exert attractive force upon them are bound on or buried in the side edges of members 28A and 28B.

What is claimed is:

1. A casing (12) for an electronic apparatus comprising a box-like casing body (21) and a lid (28);

said casing body (21) including an upper surface having an open portion (22) therein, a front portion positioned forwardly of said open portion, a rear portion positioned rearwardly of said open portion and a pivot portion (30) proximate to said rear portion, said lied (28) including a first rectangular platelike member (28A) having first front and rear edges, said first rear edge being attached pivotally to said pivot portion (30) and a second rectangular platelike merber (38B) having second front and rear edges, said second rear edge being attached pivotally to said first front edge of said first platelike member, said platelike members being dimensioned to cover said open portion when said lid is extended to a generally planar closed position and to expose said open portion when said lid is folded to an open position, a first fixing means (34, 35) for causing the second front edge of said second platelike member to be fixed to said front portion of the casing body in said closed position, a second fixing means (34, 36) for causing the second front edge of said second platelike member to be fixed to said rear portion of the casing body in said open position, said first fixing means (34, 35) comprising a protrusion member (34) integrally formed on the second front edge of the second platelike member and a first convex portion (35) integrally formed on the front portion of the casing body such that said protrusion member (34) may engage said first convex portion (35), whereby said lid (28) may be firmly positioned in the closed position so as to cover said open portion (22) by extending said two platelike members (28A, 28B), and said second fixing means (34, 36) comprising said protrusion merber (34) and a second convex portion (36) integrally formed on the rear portion of the casing body such that said protrusion member (34) may engage said second convex portion (36), wherein said lid (28) may be firmly positioned in the open position so as to expose said open portion (22) by folding said two platelike members (28A, 28B), said first front edge of the first platelike members (28A) being positioned rearwardly of said pivot portion (30) and said second front edge of the second platelike members (28B) being positioned forwardly of said pivot portion (30) when said lid is positioned in said open position.

2. A casing for an electronic apparatus as defined in claim 1 wherein said lid includes a side edge and said open portion includes sides and wherein said first fixing means (34, 35) includes a step portion (38) disposed along the sides of the open portion (22) of the casing body in such a manner that the side edge of the lid may rest thereon in the closed position.

3. A casing for an electronic apparatus as defined in claim 2 wherein said first fixing means (34, 35) includes magnetic members (43A, 43B; 44A, 44B) attached respectively opposite the lid and the casing body such that they exert attractive force upon each other in the closed position.

4. A casing for an electronic apparatus as defined in claim 1 wherein said first fixing means (34, 35) includes magnetic members (43A, 43B; 44A, 44B) attached respectively to the lid and the casing body such that in the closed position they exert attractive force upon each other.

5. A casing for an electronic apparatus as defined in claim 1, comprising a means (40) for supporting the substantially central portion of the lid when it is in the closed position.

* * * * *